US005564133A

United States Patent [19]

Kishi

[11] Patent Number: 5,564,133

[45] Date of Patent: Oct. 15, 1996

[54] RAW SEWAGE DISPOSAL APPARATUS

[75] Inventor: Mitsuhiro Kishi, Ashikaga, Japan

[73] Assignee: Nikken Corporation, Tokyo, Japan

[21] Appl. No.: 342,415

[22] Filed: Nov. 18, 1994

[30] Foreign Application Priority Data

Nov. 19, 1993 [JP] Japan ..... 5-314445

[51] Int. Cl.[6] ..... A47K 11/02

[52] U.S. Cl. ..... 4/111.1; 4/111.5; 4/111.6; 422/309; 366/231; 34/95

[58] Field of Search ..... 366/230, 231, 366/342, 343; 4/111.1, 111.2, 111.3, 111.4, 111.5, 111.6; 422/309; 110/214; 34/60, 71, 108, 130, 132, 95

[56] References Cited

U.S. PATENT DOCUMENTS

| | | | |
|---|---|---|---|
| 1,973,002 | 9/1934 | Kroepfle | 366/230 |
| 3,430,927 | 3/1969 | Pouzar | 366/231 |
| 3,546,430 | 12/1970 | Kane | 366/230 |
| 3,890,566 | 6/1975 | Nordblad et al. | 34/95 |
| 4,014,105 | 3/1977 | Furgal et al. | 34/60 |
| 4,112,523 | 9/1978 | Williams | 4/111.5 |
| 4,173,925 | 11/1979 | Leon | 366/231 |
| 4,674,886 | 6/1987 | Uesaka et al. | 366/231 |
| 4,999,930 | 3/1991 | Kishi et al. . | |
| 5,058,213 | 10/1991 | Kishi et al. . | |
| 5,152,074 | 10/1992 | Kishi . | |
| 5,230,164 | 7/1993 | Kishi . | |
| 5,257,466 | 11/1993 | Kishi . | |
| 5,261,126 | 11/1993 | Kishi . | |

FOREIGN PATENT DOCUMENTS

| | | | |
|---|---|---|---|
| 1054307 | 5/1979 | Canada | 4/111.1 |

OTHER PUBLICATIONS 13 sheets of drawings from U.S. Ser. No. 08/143 522, filed on Oct. 26, 1993.

*Primary Examiner*—Henry J. Recla
*Assistant Examiner*—Charles R. Eloshway
*Attorney, Agent, or Firm*—Flynn, Thiel, Boutell & Tanis, P.C.

[57] ABSTRACT

A raw sewage disposal apparatus capable of easily stirring raw sewage and cleaning a container by rotating the container per se after introducing the raw sewage into the container and heating, evaporating and drying the raw sewage. The raw sewage disposal apparatus comprises a container for accommodating raw sewage therein, an electromagnetic heater for heating the container, a rotary holder for rotatably holding the container, a driver for rotating the container, spherical stirrers accommodated in the container, and a nonrotatable baffle having one end fixed to the cover plate and the other end extending to a position adjacent to the bottom of the container so as to contact the stirrers.

14 Claims, 10 Drawing Sheets

RAW SEWAGE DISPOSAL APPARATUS

FIELD OF THE INVENTION

The present invention relates to a raw sewage disposal apparatus for disposing of raw sewage, which apparatus can be utilized outside, in a vehicle such as a vessel or train, or in a tunnel through which a vacuum truck used for collecting raw sewage cannot go and, more particularly, relates to such an apparatus capable of performing the stirring of the raw sewage and cleaning of a drying cauldron by rotating the drying cauldron per se.

BACKGROUND OF THE INVENTION

The raw sewage discharged from human bodies is typically discharged into a sewage system by use of a flush toilet or the like and then flows into a river after being temporarily contained in a holding tank and purified therein. However, at events such as festivals, athletic events, fairs, meetings and the like, temporary toilet facilities must be provided for disposal of raw human waste.

Employed conventionally are movable temporary toilets, most of which have a tank for temporarily storing the raw sewage therein. However, the temporary toilets have the problem that the raw sewage contained in the tank must be sucked into a vacuum truck for collection and the collected raw sewage must be transferred to a raw sewage disposal purifying facility, which is laborious and time consuming and is unhygienic.

Transportation vehicles, such as trains, buses, vessels, etc., which operate over long distances are provided with a tank exclusively used for storing and holding the discharged raw sewage. The raw sewage in this tank is subjected to a deodorizing treatment by chemicals and thereafter is collected by a vacuum truck at a terminal or relaying point.

As mentioned above, the raw sewage in conventional temporary toilets or movable transportation facilities is contained as it is discharged from the human body and is collected thereafter. Accordingly, the storing method, the collection method and the disposal method are not modern and are very unhygienic. Accordingly, if the temporary toilet has been used for a long period of time, the discharged raw sewage remains in the tank, which cause a bad smell. Furthermore, since operators dislike disposing of the raw sewage, it is not preferable in view of modernization of maintenance of the temporary toilet.

In an attempt to ameliorate the above problems, there have been proposed several hygienic disposal methods. In one method, for example, chemicals are introduced into the tank where the raw sewage is contained to thereby prevent the generation of the bad smell and to effect sterilization of the sewage. This method, however, cannot be used for a long period of time because the chemicals become diluted and costs are high though it is often employed in transportation vehicles.

In another method, the raw sewage is contained in a bag made of vinyl and the like to prevent the diffusion of the bad smell. This method, however, requires a vinyl bag of large size and involves a high cost for disposal thereof, and it is troublesome to separate the raw sewage from the bag. A large-scale disposal facility is also required.

In still another method, the discharged raw sewage is directly dried by use of heat from a burner, etc. Since the primary component of raw sewage is the liquid component, a large amount of heat energy is required to remove the liquid component and it takes a long period of time to effect one time disposal of the raw sewage.

In view of the drawbacks of the conventional methods of disposing of the raw sewage, the present inventor proposed a disposing apparatus having the drying cauldron provided with stirring blades and heat-holding balls therein in which the raw sewage is stirred by the rotation of the stirring blades and heated by heat released by the heat-holding balls whereby the raw sewage is dried in a short period of time and the liquid component which is the primary component of raw sewage is evaporated as disclosed in Japanese Patent Nos. 63-124150 and 2-411577, U.S. Pat. Nos. 4,999,930, 5,058,213, 5,152,074, 5,230,164 and 5,257,466, and U.S. Pat. Application Ser. Nos. 07/809 962 filed Dec. 18, 1991 abandoned and replaced by continuation application Ser. No. 08/143,522, filed Oct. 26, 1993, now U.S. Pat. No. 5,418, 982 and Ser. No. 07/985 556, filed Dec. 3, 1992, now U.S. Pat. No. 5,261,126.

According to the proposed disposal methods, the raw sewage is heated, evaporated in the drying cauldron and diffused into the ambient atmosphere. Before the liquid component is diffused, the components which cause bad smell are resolved by a catalyst so that the liquid water is diffused into the atmosphere as an odorless vapor. It was preferable to employ such a method in view of environmental hygiene and preservation even if such method is employed in crowded buildings and/or by throngs of people.

It is very hygienic to evaporate and diffuse the raw sewage contained in the airtight drying cauldron and such operations can be carried out systematically, which results in not causing a burden to the operators. It is necessary to stir the raw sewage which is contained in the airtight drying cauldron so as to heat and evaporate the raw sewage uniformly and residual substances which are not evaporated must be removed. There is employed the arrangement of a stirring blade for stirring the residual substances in the drying cauldron and a cleaning mechanism.

In the arrangement for providing the stirring blade, it is necessary to provide a rotary shaft which extends perpendicular relative to the drying cauldron, which increases the height of the apparatus as a whole and which makes the mechanism very large. There is a case that foreign matter which cannot be evaporated, such as a metallic ball-point pen, a belt, clothing, etc. are introduced into the drying cauldron. In such a case, when the raw sewage is stirred, the foreign matter enters a gap between the stirring blade and the drying cauldron, which prevents the stirring blade from rotating, and hence causes trouble. Since the rotary shaft and the stirring blade must be accommodated inside the drying cauldron, the limited inner space of the drying cauldron is occupied by these mechanisms. As a result, the inner space of the drying cauldron cannot be effectively utilized, which leads to inconveniences.

Under the circumstances, it is desired to develop a raw sewage disposal apparatus capable of utilizing the inner space of the drying cauldron without accommodating the rotary shaft and the stirring blade inside the drying cauldron and also capable of stirring the raw sewage and cleaning the drying cauldron.

The present invention provides a raw sewage disposal apparatus comprising a metallic heat-resistant container for accommodating raw sewage therein, an electromagnetic heater provided adjacent to the container for generating high-frequency electromagnetic wave, a rotary holder for rotatably holding the container about a vertical shaft hereof as a rotary shaft, a driving means for rotating the container, at least one spherical stirrer accommodated in the container, and at least one nonrotatable baffle having a lower end which extends to the portion adjacent to the bottom of the container so as to contact the stirrer.

According to the present invention, the drying cauldron per se containing the raw sewage therein can be rotated horizontally and spherical stirring balls are accommodated inside the drying cauldron. With such an arrangement, when the drying cauldron is rotated, the stirring balls contained in the drying cauldron are rotated so that the raw sewage is stirred. A heater unit having a high-frequency coil therein is disposed under the drying cauldron wherein the high-frequency electromagnetic wave is generated by the heater unit. The electromotive wave transmits to the drying cauldron and the inside of the stirring balls, so that the drying cauldron and the stirring balls per se generate heat by electromagnetic induction heating. As a result, the temperature of the raw sewage is increased.

In such a manner, when the heater unit is heated while the drying cauldron is rotated, the raw sewage contained inside the drying cauldron is heated while it is stirred so that the liquid component which is a primary component of the raw sewage can be evaporated as vapor. Residual substances such fibrous substances which cannot be evaporated from the raw sewage remain inside the drying cauldron upon completion of the drying operation of the raw sewage. The substances are sliced off when the stirring balls are rotated in the drying cauldron and then they are reduced to powder, eventually changed into dust. This dust is sucked in the same principle as a vacuum cleaner so that the powdered dust which remains inside the drying cauldron can be cleaned.

With such an arrangement of the drying cauldron, the inside structure of the drying cauldron is simplified, whereby a stirring blade, which has been employed in the prior art raw sewage apparatus, does not bite into the metallic foreign matter or clothing even if they are present into the drying cauldron so that the rotation of the drying cauldron is not obstructed. Further, the raw sewage is not stirred by the stirring blade so that the drying cauldron can be rotated with assurance without trouble. As a result, such raw sewage disposal apparatus can be used for a long period of time.

DETAILED DESCRIPTION

Figure 1:
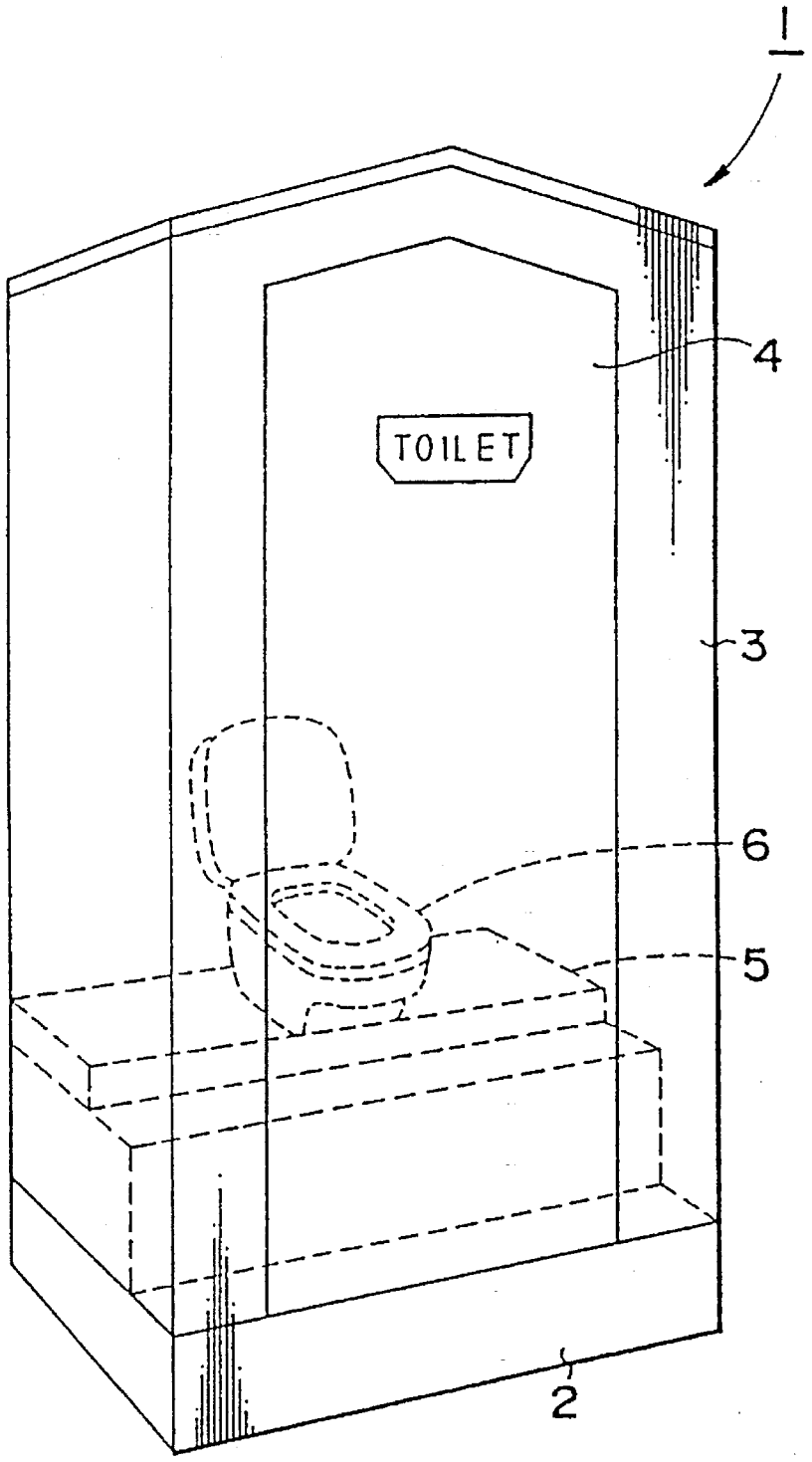
FIG. 1 is a perspective view showing a disposal system of a temporary toilet using a raw sewage disposal apparatus according to a preferred embodiment of the present embodiment.

FIG. 1 shows the temporary toilet 1. The outer frame of the temporary toilet 1 is made of, e.g. plastic or reinforced synthetic resin and has a cubic boxlike shape. The temporary toilet 1 has a base 2 which can be supported on the ground at the bottom portion thereof. The base 2 has a cubic shape and has a roofed house 3 fixed thereto at the upper portion thereof. A door 4 is attached to the front surface of the house 3 and opens forward thereof so that the user can go in and out the house 3.

The temporary toilet 1 has inside thereof a raw sewage disposal apparatus 5 which is fixed to an upper portion of the base 2. A western-style stool 6 is fixed to an upper portion of the disposal apparatus 5 and the user using the temporary toilet can utilize the stool 6 for discharging the raw sewage.

Figure 2:
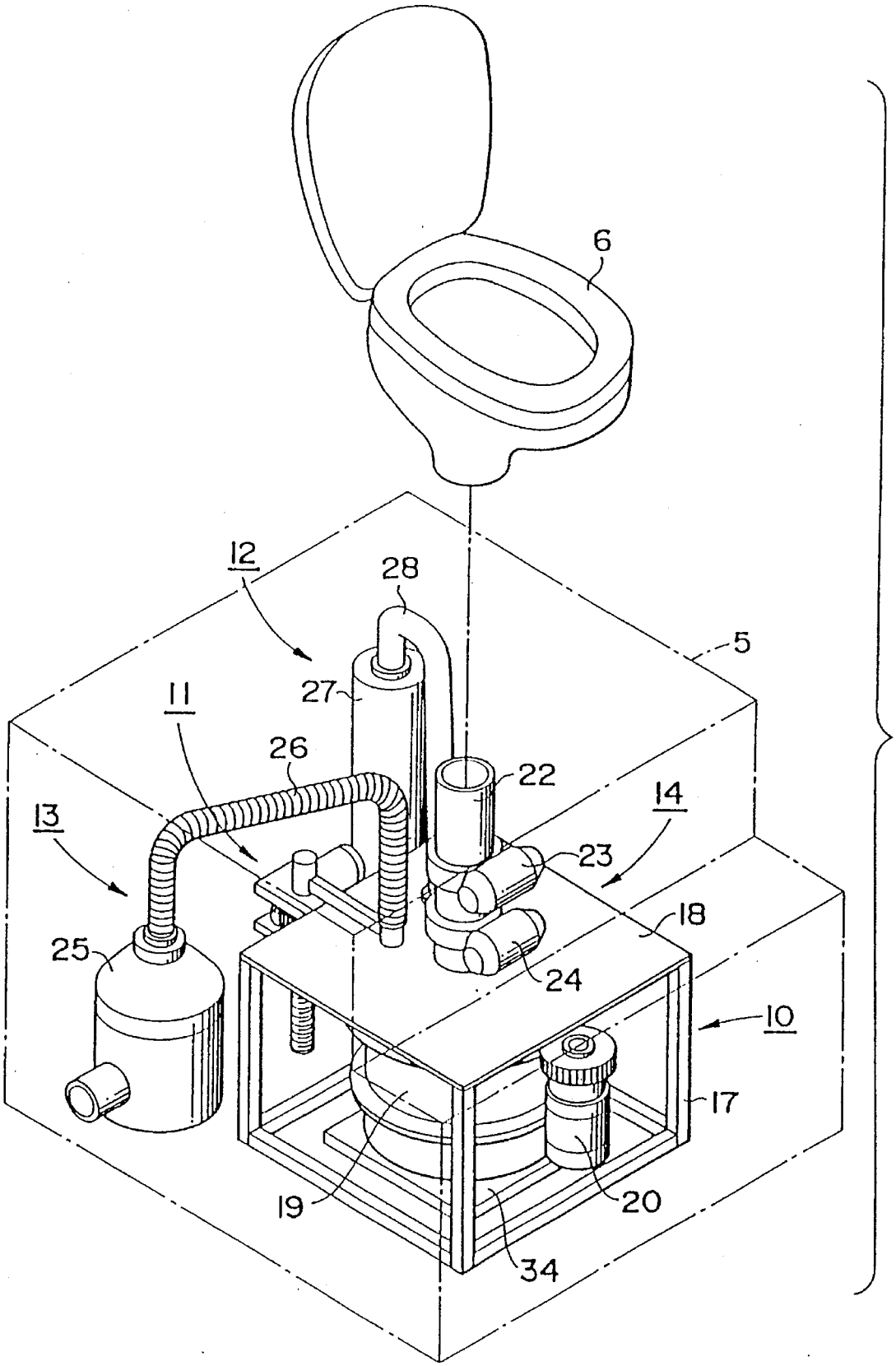
FIG. 2 is a perspective view of an entire arrangement of the raw sewage disposal apparatus of FIG. 1.

FIG. 2 is a perspective view of an entire arrangement of the raw sewage disposal apparatus. Main constituents of the raw sewage disposal apparatus 5 are shown by solid lines. The raw sewage disposal apparatus 5 is assembled as a unit which is operable by reception of power. The raw sewage disposal apparatus 5 comprises a drying portion 10, an insertion operation portion 11, a deodorizing portion 12, a dust collecting portion 13 and a raw sewage introduction portion 14.

In FIG. 2, the drying portion 10 is provided at the front central portion in the raw sewage disposal apparatus 5 and it is structured by a cubic holding body 17 which is assembled by square pipes in a frame shape. A drying cauldron 19 serving as a container means is rotatably accommodated in the inner central portion of the holding body 17. A motor 20 serving as a driving means for driving the drying cauldron 19 is attached to the holding body 17. A heater unit 34 having a high-frequency coil therein as an electromagnetic heating means is fixed near the lower end of the drying cauldron 19. A flat cover plate 18 is fixed to the upper surface of the holding body 17 and it is integrated with the holding body 17. The upper opening of the drying cauldron 19 is shielded by the cover plate 18.

A hollow introduction pipe 22 is vertically disposed at the center of the cover plate 18 and the upper open end thereof communicates with the lower surface of the stool 6. Shutters 23 and 24 serving as a valve means are attached in two stages to the introduction pipe 22 (at any portion thereof) in a manner whereby they are arranged vertically. When the shutters 23 and 24 are alternately opened or closed, the stool 6 communicates with the drying cauldron 19 through the introduction pipe 22.

An insertion operation portion 11 is disposed at the rear portion of the holding body 17 and a deodorizing portion 12 and a dust collecting portion 13 are disposed at the rear right and left sides of the drying portion 10. The deodorizing portion 12 removes a bad smell component of the air including vaporized water generated in the drying cauldron 19 when it discharges such air including vaporized water. The deodorizing portion 12 comprises a cylindrical reduction catalyst box 27 which has a vertical axial line. A discharge pipe 28 connects the upper surface of the cover plate 18 and the upper end of the reduction catalyst box 27 so that the inside of the drying cauldron 19 communicate with the inside of the reduction catalyst box 27. The dust collecting portion 13 sucks the residual substances which remain inside the drying cauldron 19 after the raw sewage is subjected to the drying process and it can separate the dust from the air, thereby cleaning the residual substances. The dust collecting portion 13 comprises a separation box 25 having an inner structure like a vacuum cleaner. The upper end of the separation box 25 and the insertion operation portion 11 can be flexibly bent and they are connected to each other by a hollow joint pipe 26 which maintains its inner space. The inside of the drying cauldron 19 can communicate with the inside of the separation box 25 by the joint pipe 26.

Figure 3:
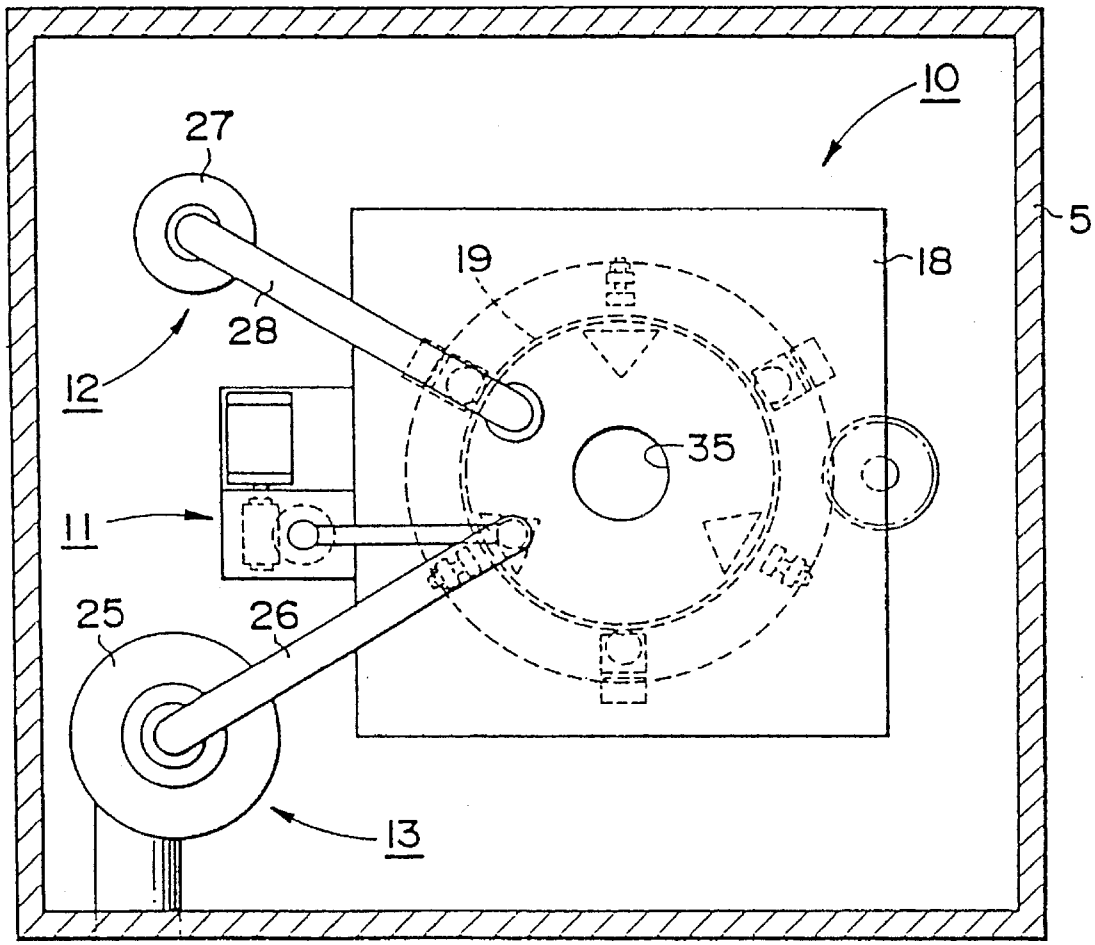
FIG. 3 is a plan view of the raw sewage disposal apparatus of FIG. 1 in which a stool is removed for explaining the inner structure of the raw sewage disposal apparatus.

FIG. 3 is a plan view of the raw sewage disposal apparatus 5 of FIG. 2 in which the introduction pipe 22 is removed from the cover plate 18, and hence the drying cauldron 19 which is placed under and hidden by the cover plate 18 is shown by broken lines.

Figure 4:
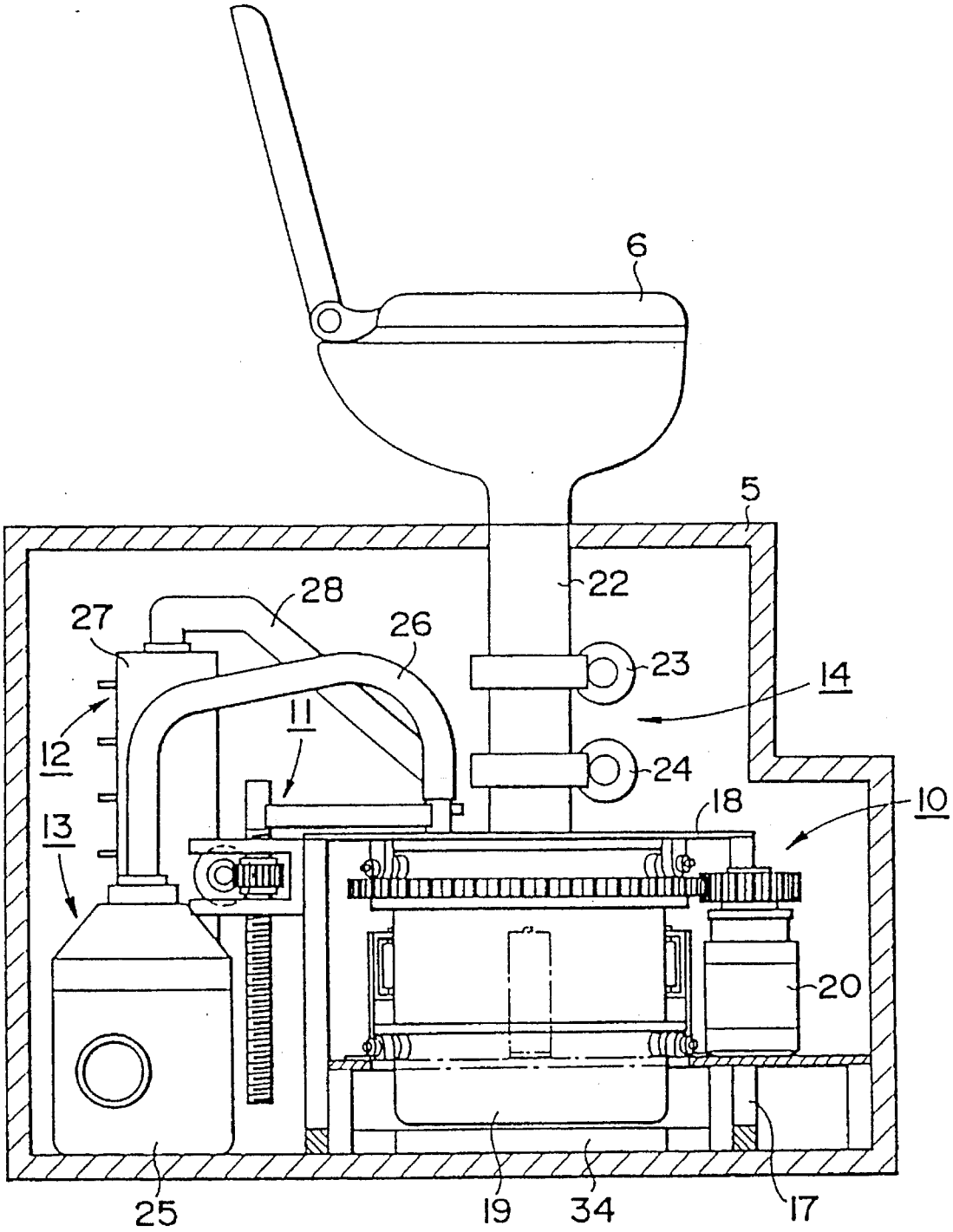
FIG. 4 is a side view of the raw sewage disposal apparatus of FIG. 1 in which an outer frame is shown as a broken line for explaining the inner structure of the raw sewage disposal apparatus.

FIG. 4 is a side view showing the state where the outer frame is broken away and a part of the holding body 17 is also broken away to show the raw sewage disposal apparatus 5 of FIG. 2 from the inside thereof.

Figure 5:
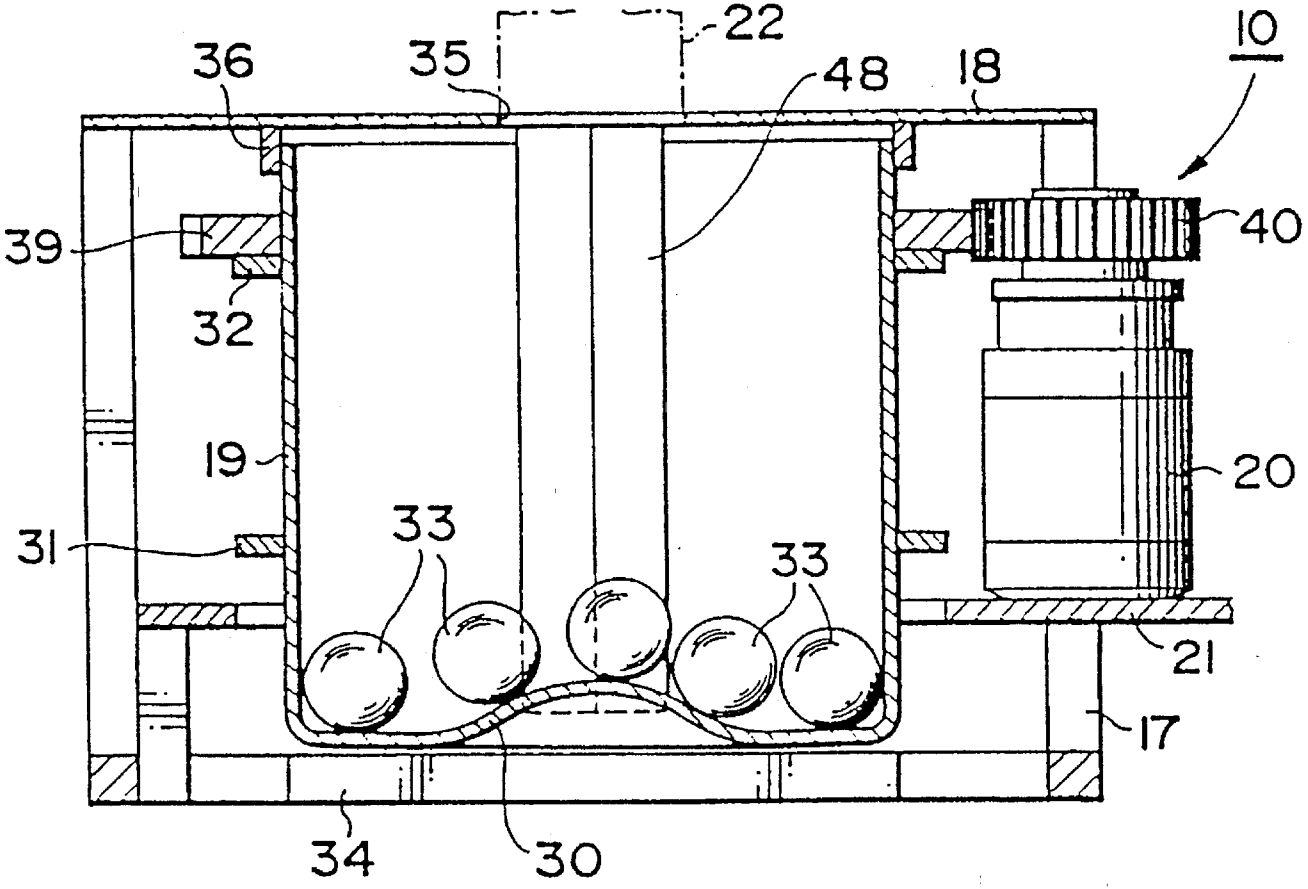
FIG. 5 is a side cross-sectional view of the raw sewage disposal apparatus of FIG. 1 in which a drying cauldron is cut at the center thereof for explaining the inner structure thereof.

FIG. 5 is a view showing an internal structure of the drying portion 10 and showing the drying cauldron 19 cut in its longitudinal direction along the central axis thereof.

Figure 6:
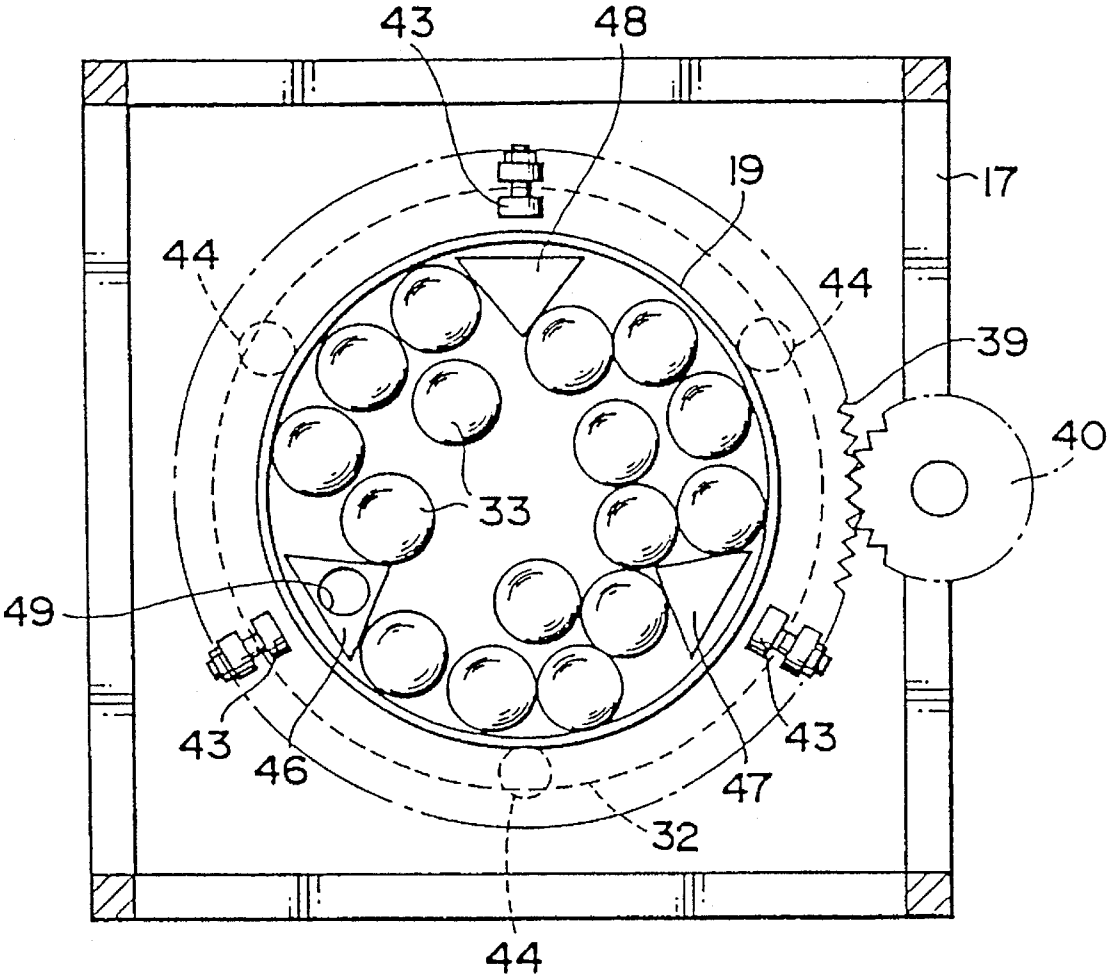
FIG. 6 is a plan view of the raw sewage disposal apparatus of FIG. 1 in which a cover plate is removed for explaining the inner structure of the drying cauldron.

FIG. 6 is a plan view showing the state where the cover plate 18 disposed over the drying portion 10 is removed and the drying cauldron 19 is shown from the upper portion thereof.

Figure 7:
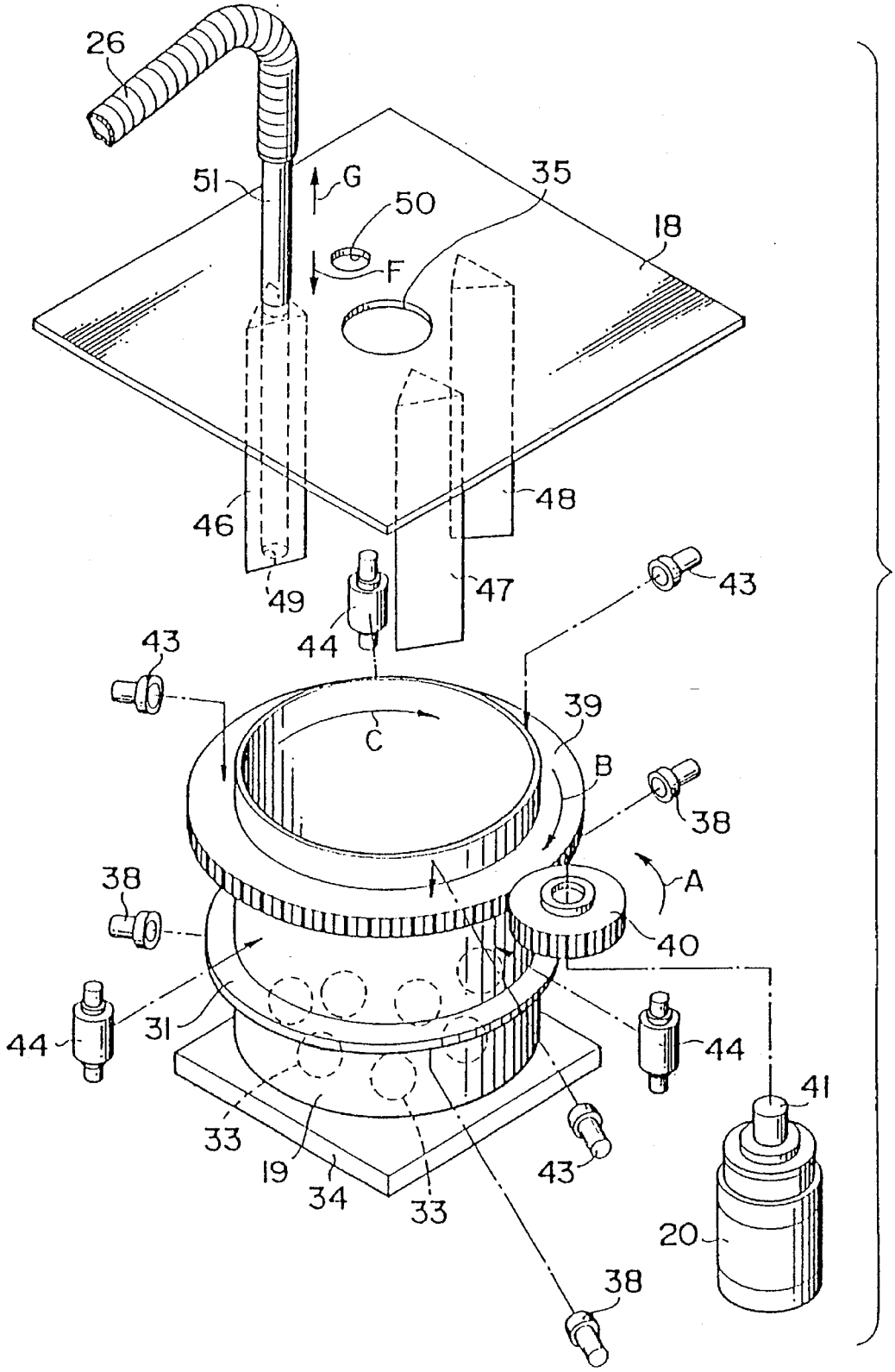
FIG. 7 is a perspective exploded view of the raw sewage disposal apparatus of FIG. 1 for explaining a holding mechanism and a driving mechanism of the drying cauldron.

FIG. 7 is a perspective exploded view showing the state where the cover plate 18 is slightly moved upward and members around the drying cauldron 19 are removed for explaining various members disposed adjacent to the drying cauldron 19 of the drying portion 10.

Figure 8:
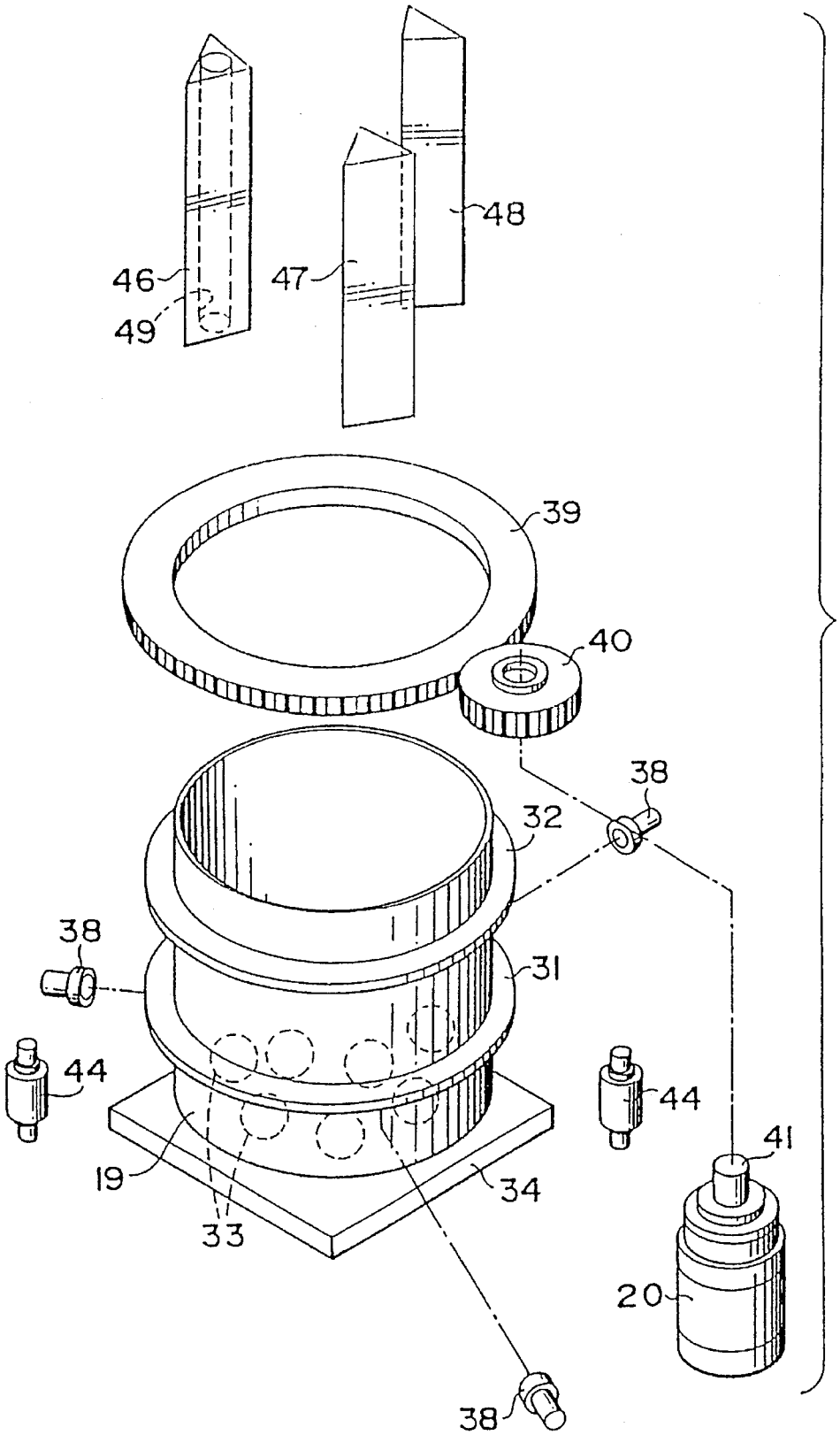
FIG. 8 is a perspective exploded view of the raw sewage disposal apparatus of FIG. 1 for explaining constituents provided close to the drying cauldron.

FIG. 8 is a perspective exploded view wherein part of the members are omitted for explaining the driving mechanism of the drying cauldron 19 of FIG. 7 more in detail.

The arrangement of the drying portion 10 will be described more in detail with reference to these FIGS. 5 to 8.

The outer frame of the drying portion 10 is composed of the holding body 17 which is formed by assembling iron square pipes in a boxlike shape with the four pipes being disposed at the four corners. The holding body 17 is hollow at the central portion thereof, and the drying cauldron 19 is disposed at the central portion of the holding body 17. A flat plate-shaped motor table 21 is fixed horizontally inside the holding body 17 slightly above the lower portion thereof. A large circular hole is defined through the central portion of the motor table 21, and the drying cauldron 19 is inserted into this hole so as not to contact the motor table 21 even if the drying cauldron 19 is rotated. A bottom portion of a motor 20 is placed on the upper surface of the motor table 21.

The drying cauldron 19 is formed of a heat-resistant metallic material such as iron, stainless steel, etc. which resists deformation under heat. The drying cauldron 19 has a cylindrical-shape which is largely opened at the upper end thereof and has a bottom wall. The outer periphery of the sidewall of the cauldron is circular and the central portion of the bottom wall has a central projection 30 which is upheaved upward like a ridge. The upper open end of the drying cauldron 19 is positioned adjacent to the lower surface of the cover plate 18 and is rotatably held thereby, and an introduction port 35 is opened at a position of the cover plate 18 corresponding to the central axis of the drying cauldron 19. The lower end of the introduction pipe 22 is connected to the introduction port 35. A ring-shaped seal 36 is fixed under the lower surface of cover plate 18 so that it slightly contacts the outer periphery of the drying cauldron 19 so as to maintain the airtightness therein. With such an arrangement, the upper opening of the drying cauldron 19 is closed by the cover plate 18 and the seal 36 so as to form a space which is made airtight and closed from the outside. A plurality of stirring bodies 33, serving as stirring means, are contained inside the drying cauldron 19. The stirring bodies 33 are preferably spherical and are formed of sintered material (such as cast iron, stainless steel, etc., if need be).

A mechanism for supporting the drying cauldron 19 and a mechanism for rotating the drying cauldron 19 are described hereinafter with reference to FIGS. 6 to 8.

Ring-shaped holding rings or bands 31 and 32 are fixed to the upper and lower portions of the outer periphery of drying cauldron 19 so that drying cauldron 19 is fastened by the holding rings 31 and 32 in two stages which are spaced vertically. Three rotatable supporting rollers 38 contact the lower surface of the holding ring 31 and each supporting roller 38 is positioned horizontally in equal intervals (spaced angularly 120° horizontally) and they are supported by the holding body 17. Accordingly, the holding ring 31 is vertically held by the three rotatable supporting rollers 38 whereby the holding ring 31 is held rotatably vertically about the central axis thereof. As a result, the weight of the drying cauldron 19 fixed to the holding ring 31 is supported by the supporting rollers 38 so that the drying cauldron 19 per se can be at the same time rotatably held in the peripheral direction thereof.

Three side rollers 44 contact the side surface of the drying cauldron 19 and each of the side rollers 44 is rotatably supported by the holding body 17 so that the axis of each of the side rollers 44 is held vertical. Each of the side rollers 44 is positioned around the drying cauldron 19 in equally spaced intervals (spaced angularly 120° horizontally) and the side rollers 44 are positioned at a central position between the holding rings 31 and 32. Since the side rollers 44, which are rotatably supported by the holding body 17, contact three portions of the outer periphery of the drying cauldron 19, the drying cauldron 19 is restricted to rotate at the position without displacing the central axis thereof.

A large gear 39 which is opened largely at the center thereof and has a tooth surface at the outer periphery thereof is inserted onto the drying cauldron 19 from the upper opening thereof and the upper surface of the holding ring 32 is brought into contact with the lower surface of the large gear 39. An inner diameter of the large gear 39 is conformed to be substantially the same as an outer diameter of the drying cauldron 19 and the large gear 39 nonrotatably engages the upper surface of the holding ring 32 like a band. Three stabilizer rollers 43 contact the upper surface of the large gear 39 and each of the rollers 43 is rotatably supported by the holding body 17. Each of the rollers 43 is positioned around the drying cauldron 19 in equally spaced intervals (spaced angularly 120° horizontally) and is positioned over the supporting roller 38.

As mentioned above, the drying cauldron 19 is rotatably contacted by the three supporting rollers 38, the stabilizer rollers 43 and the side rollers 44, so that the drying cauldron 19 is always rotatably held by these rollers while the axial line thereof is held perpendicular (i.e. vertical) to the top plate.

A small gear 40 which has a tooth surface at the outer periphery thereof meshes with the outer periphery of the large gear 39. Gear 40 is fixed to an output shaft 41 of the motor 20. With such an arrangement, when the output shaft 41 of the motor 20 is rotated, the small gear 40 and then the large gear 39 are driven, successively the holding ring 32 fixed to the large gear 39 and the drying cauldron 19 are respectively rotated while the axial lines thereof are held vertical.

Upper ends of three baffle plates 46, 47 and 48 serving as baffle means are fixed to the cover plate 18 and project downwardly inside the drying cauldron 19. The baffle plates 46, 47 and 48 are positioned in equally divided intervals about the introduction port 35 (spaced angularly 120° horizontally). Each of the baffle plates 46, 47 and 48 is elongate vertically and triangular in horizontal cross section. The lengths of the baffle plates 46, 47 and 48 are set so that the lower ends thereof are positioned closely adjacent but slightly spaced from the lower surface of the drying cauldron 19. The baffle plates 46, 47 and 48 thus hang down into the drying cauldron 19. A cleaning hole 49, which is elongate vertically, is penetrated inside the baffle plate 46 which is elongate vertically and a hollow cleaning pipe 51 is inserted into the cleaning hole 49.

A discharge port 50 is formed through the cover plate 18 at the position close to the introduction port 35, the port 50 being between the baffle plates 46 and 48.

A heater unit 34 having a high-frequency coil therein for generating a high-frequency electromagnetic wave is disposed horizontally under the drying cauldron 19. The heater unit is slightly spaced from the lower surface of the drying cauldron 19.

Figure 9:
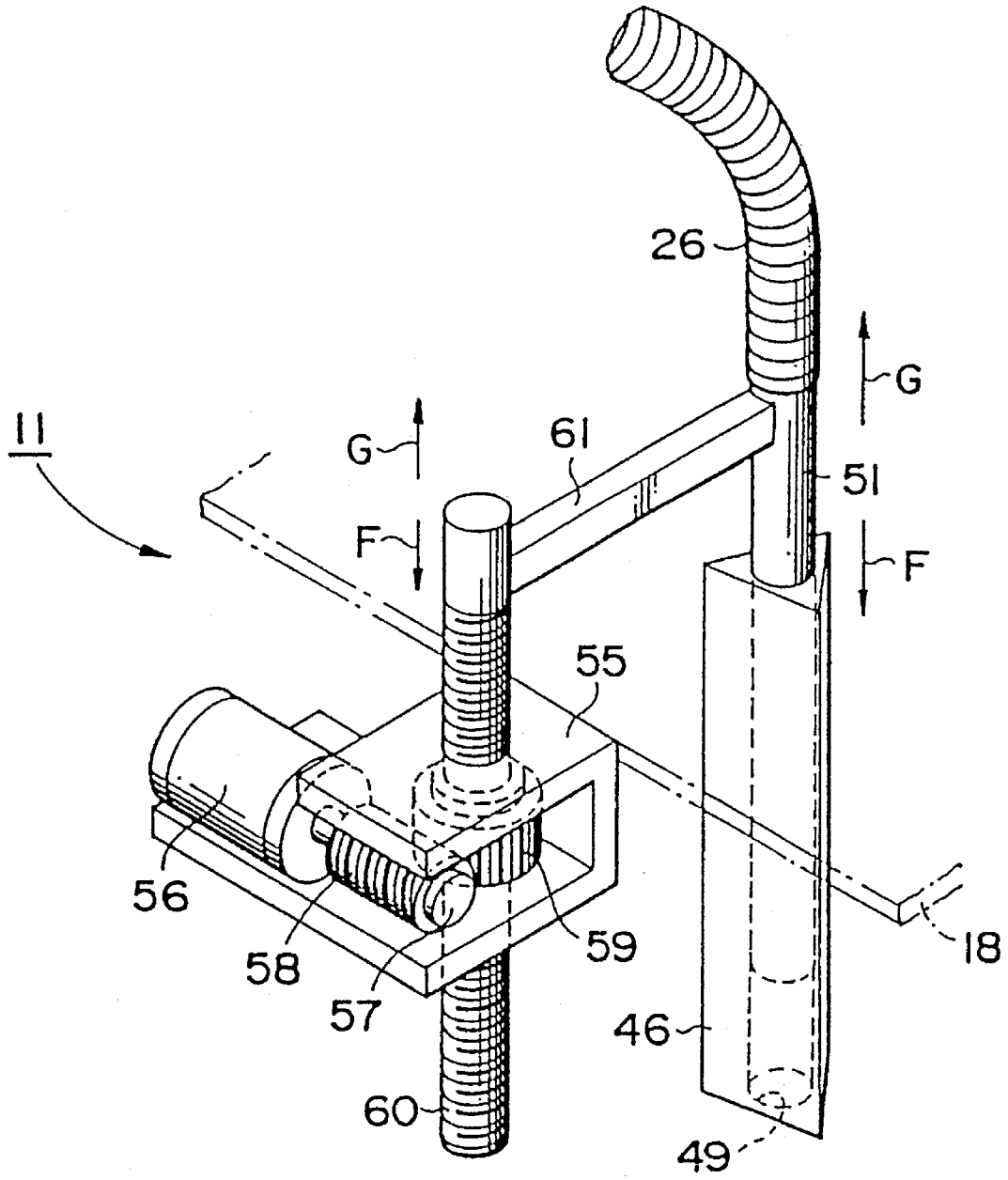
FIG. 9 is a perspective view of a main structure of an insertion operation portion of the raw sewage disposal apparatus of FIG. 1 for explaining the operation of the insertion operation portion.

The arrangement of the insertion operation portion 11, which is provided adjacent the drying portion 10, will now be described with reference to FIG. 9. An angle body 55 which has a U-shaped bent portion in cross section is fixed to the side surface of the cover plate 18, and the U-shaped bent portion has an opening which is directed to the outside. An elevating motor 56 is fixed to the angle body 55 in the U-shaped bent portion thereof so that the axial line thereof is held horizontally. A worm 58 is fixed to a rotatable output shaft 57 of the elevating motor 56 and it meshes with a worm gear 59 which is inserted into the space of the U-shaped bent portion. The angle body 55 has aligned upper and lower openings, and a long screw rod 60 is vertically inserted into the openings of the angle body 55 in which a male screw formed at the periphery of the screw rod 60 is screwed into a female screw formed inside the worm gear 59.

A connecting rod 61 is fixed to the upper end of the screw rod 60 and it extends horizontally toward the center of the cover plate 18, and the tip end of the connecting rod 61 is fixed to the upper end of the cleaning pipe 51. With such an arrangement, when the output shaft 57 of the elevating motor 56 is rotated, the worm 58 is driven and rotated so that the worm gear 59 meshing with the worm 58 is rotated. When the worm gear 59 is rotated, the female screw formed at the center of the worm gear 59 slides around the male screw formed on the periphery of the screw rod 60 so that the screw rod 60 is moved vertically. When the screw rod 60 is moved vertically, the connecting rod 61 and the cleaning pipe 51 are moved vertically so that the cleaning pipe 51 is vertically slid inside the cleaning hole 49 of the baffle plate 46.

Figure 10:
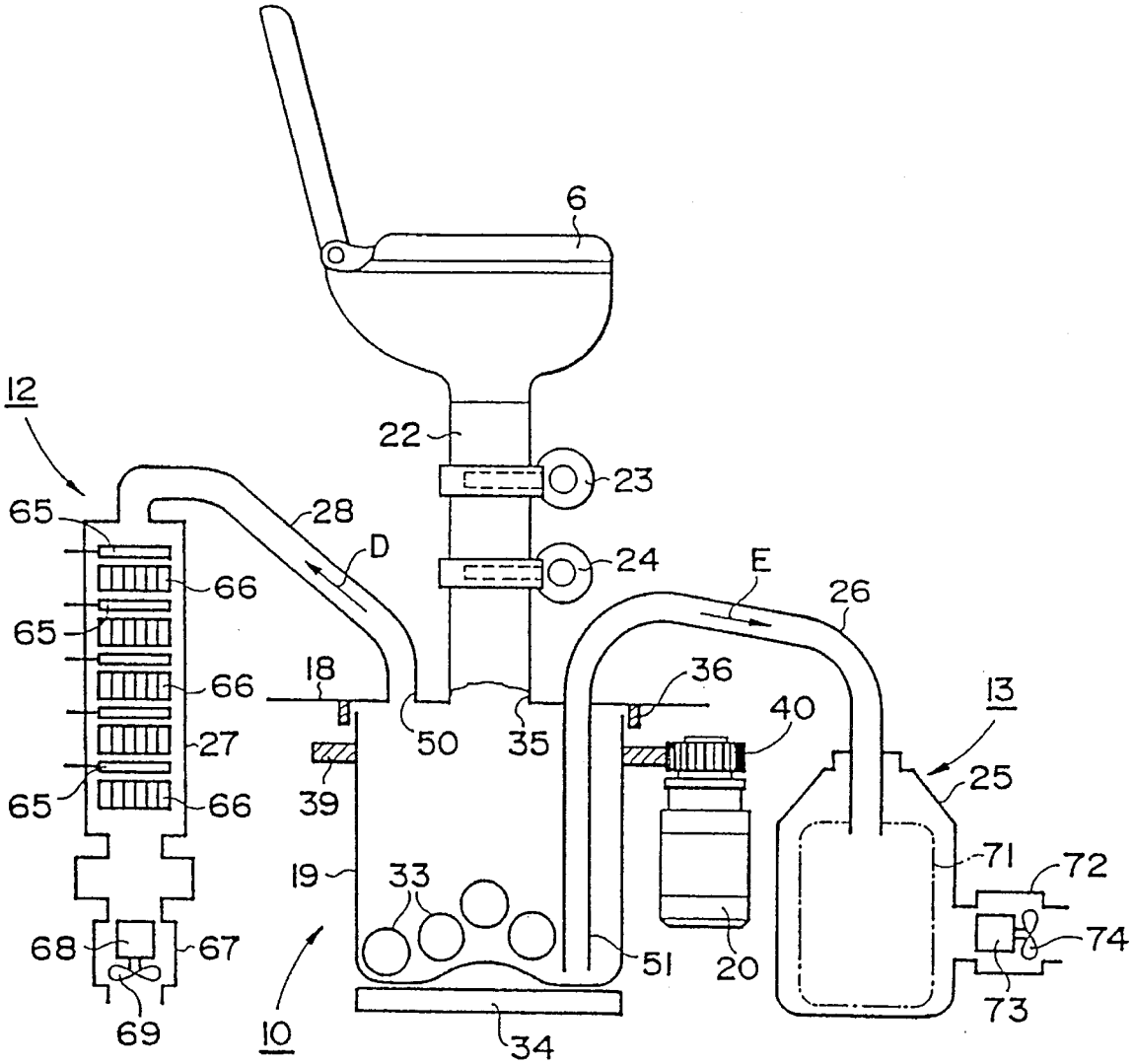
FIG. 10 is a view showing a piping system for connecting all constituents of the raw sewage disposal apparatus.

The connection of each constituent of the raw sewage disposal apparatus 5 is explained with reference to FIG. 10.

The drying cauldron 19 has a drum shape having the opening at the upper end and the bottom wall at the lower end. The cover plate 18 is provided horizontally at a portion close to the opening of the drying cauldron 19 and the ring-shaped seal 36 is provided so as to lightly contact the outer periphery of the upper end of the drying cauldron 19. There is formed a space by the drying cauldron 19, cover plate 18 and seal 36 which is made airtight from the outside. The lower end of the introduction pipe 22 communicates with the cover plate 18 and the upper end of the introduction pipe 22 is connected to the lower end opening of the stool 6. The shutters 23 and 24 are provided at any portion on the introduction pipe 22. Accordingly, the raw sewage discharged toward the stool 6 passes through the introduction pipe 22, shutters 23 and 24 and then drops inside the drying cauldron 19 through the introduction port 35.

One end of the air discharge pipe 28 is connected to the discharge port 50 which is defined through the cover plate 18 and the other end of the discharge pipe 28 is connected to the upper end of the deodorizing portion 12. The reduction catalyst box 27 is cylindrical in outer shape thereof and is upright and is hollow inside thereof. A heater 65 and a catalyst 66 are alternately disposed in the reduction catalyst box 27 so as to be vertically layered. The heater 65 generates heat by receiving the power supply and reheats the discharged air. The catalyst 66 includes precious metal such as platinum, palladium, etc. and has a honeycomb structure so as to enable the air to flow therethrough. In the reduction catalyst box 27, the heater 65 heats the air including bad smell component which is generated inside the drying cauldron 19 and the catalyst 66 passes the air therethrough, thereby subjecting the air including such bad smell component to oxidation and reduction process before such air is diffused outside. An air blower 67 is connected to the lower end opening of the reduction catalyst box 27. A motor 68 and a fan 69 driven by the motor 68 are respectively accommodated in the air blower 67.

The separation box 25 constituting the dust collecting portion 13 has a structure like a vacuum cleaner. The separation box 25 has openings at the upper end and side surfaces thereof and is of bottle shape and is hollow inside thereof. The separation box 25 has inside thereof a bag-shaped dust collecting bag 71 which is formed of a material such as permeable cloth, paper, etc. and capable of catching the dust inside of the separation box 25. The remote end of the joint pipe 26 extends through the upper opening of the separation box 25 to the inside of the separation box 25 and it is connected to the dust collecting bag 71. An air blower 72 is connected to the opening at the side surface of the separation box 25 and a motor 73 and a fan 74 driven by the motor 73 are respectively accommodated inside the air blower 72.

The operation of the present embodiment will now be briefly described.

The raw sewage disposal apparatus 5 must be in a standby state before starting its operation. In this case, the shutters 23 and 24 are closed and the screw rod 60 is moved upwardly by the elevating motor 56 in the direction of arrow G (FIG. 9) and the cleaning pipe 51 is also moved in the direction of the arrow G so that the cleaning pipe 51 is pulled out from the cleaning hole 49. A high-frequency power supply is not yet supplied to the heater unit 34 and the power supply is not yet supplied to the heater 65. The motors 20, 68 and 73 are also not energized.

When using the temporary toilet 1, the user opens the door 4 and enters the house 3 and discharges raw sewage toward the stool 6. The discharged raw sewage is stored in a lower portion of the stool 6 and is temporarily stored above the closed shutter 23.

When the user presses a button (not shown) representing the completion of the use of the apparatus, the shutter 23 is opened so as to drop the raw sewage through the introduction pipe 22 and the raw sewage is temporarily stored above the closed lower stage shutter 24. If the shutter 23 is opened for a given time, it is closed and the shutter 24 is opened so as to introduce the raw sewage which was stored on the lower stage shutter 24 into the inside of the drying cauldron 19 through the introduction pipe 22. Successively, the lower stage shutter 24 is closed after a given time elapses and thus the introduction pipe 22 is closed.

When the raw sewage is introduced into the drying cauldron 19, the raw sewage must be dried and evaporated. The drying and evaporation process is automatically performed when the user presses the button, not shown.

The high-frequency power supply is supplied to the heater unit 34 by a power supply unit, not shown, so as to generate a high-frequency electromagnetic wave by the high-frequency coil accommodated in the heater unit 34 so that the electromagnetic wave is transmitted to the inside and outside of the drying cauldron 19. When the high-frequency electromagnetic wave is transmitted to the inside and outside of the drying cauldron 19, the metallic drying cauldron 19 per se generates heat due to eddy current loss and at the same time the metallic stirring bodies (i.e. balls) 33 accommodated inside the drying cauldron 19 generate heat. The heat generated by the drying cauldron 19 and stirring bodies 33 are transmitted to the raw sewage, thereby increasing the temperature of the raw sewage.

The power supply unit also starts to supply power to the motor 20, heater 65 and motor 68, thereby driving the motors 20 and 68 and heating the heater 65. When the motor 20 is driven, the output shaft 41 is rotated by the driving force of the motor 20 so that the small gear 40 coupled to the output shaft 41 is rotated in the direction of arrow A (FIG. 7). The large gear 39 meshing with the small gear 40 starts to rotate in the direction of arrow B which is opposite to the direction of arrow A and the drying cauldron 19 coupled to the large gear 39 starts to rotate in the direction of arrow C (FIG. 7). Since the drying cauldron 19 is supported by the supporting rollers 38 which engage the lower surface of the holding ring 31, the holding ring 31 is rotated horizontally in the direction of the arrow C while it rotates on the supporting roller 38. Since the drying cauldron 19 contacts the side rollers 44 at the side surface thereof, it is rotated while keeping its central axis perpendicular (i.e. vertical) and rotates the side rollers 44. The large gear 39 is placed on the holding ring 32 which is fixed to the outer periphery of the drying cauldron 19 like a band and the rollers 43 contact the upper surface of the large gear 39 at three portions thereof so that the large gear 39 is rotated while rotating the rollers 43. Since the rollers 43 are supported by the holding body 17, they restrict upward movement of the drying cauldron 19 even if the drying cauldron 19 is rotated.

As mentioned above, although the drying cauldron 19 is rotated by the motor 20 in the direction of the arrow C, the stirring bodies 33 and the raw sewage respectively accommodated inside the drying cauldron 19 are also rotated at the same time at the bottom of the drying cauldron 19 when the drying cauldron 19 is rotated. At this time, the baffle plates 46, 47 and 48 are uniformly angularly disposed at three positions close to the bottom of the drying cauldron 19 as shown in FIG. 6, and these baffle plates 46, 47 and 48 are fixed to the nonrotatable cover plate 18. Accordingly, the stirring bodies 33 which are likely to rotate when the drying cauldron 19 rotates contact the baffle plates 46, 47 and 48 when they rotate so that the rotation of the stirring bodies 33 is prevented by the baffle plates 46, 47 and 48. As a result, the stirring bodies 33 are pushed inwardly toward the center of the drying cauldron 19. However, since the shape of the bottom of the drying cauldron 19 is upheaved to form the central projection 30 as shown in FIG. 5, the stirring bodies 33 which are pushed toward the central portion of the drying cauldron 19 by the baffle plates 46, 47 and 48 pass around the baffle plates 46, 47 and 48 and are returned in a direction toward the sidewall of the drying cauldron 19 by the inclination of the central projection 30. In such a manner, the stirring bodies 33 reciprocate between the center and sidewall of the drying cauldron 19 while they are rotated and thus they repeatingly create a wavelike motion pattern. As a result, the raw sewage stored inside the drying cauldron 19 is stirred by the stirring bodies 33.

In such a manner, the heat of the drying cauldron 19 and the stirring bodies 33 which are heated by the heater unit 34 is transmitted to the raw sewage, thereby increasing the temperature of the raw sewage. At the same time, the raw sewage is stirred when the drying cauldron 19 is rotated so that the temperature of the raw sewage is uniformly increased as a whole. Also, since the raw sewage contacts all the surface of the stirring bodies 33, the transfer of the heat generated by the stirring bodies 33 having large surface areas is facilitated, thereby facilitating the increase of the temperature of the raw sewage. When the temperature of the raw sewage in the drying cauldron 19 is increased, it exceeds the boiling point so that the liquid component which is a primary component of the raw sewage is changed to vaporized water. As a result, evaporation starts. The vaporized water evaporated from the raw sewage is permitted to flow outside through the discharge port 50 which is defined through the cover plate 18 since the drying cauldron 19 is airtightly closed. Successively, the vaporized water is permitted to flow in the direction of arrow D (FIG. 10) from the discharge port 50 through the discharge pipe 28 and is moved inside the reduction catalyst box 27.

When the motor 68 of the air blower 67 operates, the fan 69 fixed to the output shaft of the motor 68 is rotated so that the fan 69 sucks the air inside the reduction catalyst box 27 and discharges such sucked air toward the outside so that the pressure inside the reduction catalyst box 27 is under negative pressure. Accordingly, the vaporized water which is permitted to flow from the discharge port 50 is sucked so as to flow through the discharge pipe 28 and the reduction catalyst box 27 so that the air including the vaporized water is successively passed through the air blower 67 and diffused outside.

The air including the vaporized water which is discharged from the drying cauldron 19 also contains a bad smell component such a urea, ammonia, etc. which are evaporated at the same time when the raw sewage is evaporated. If the vaporized water is diffused outside as it is, it causes the diffusion of the bad smell around the temporary toilet 1. Accordingly, it is necessary to change the bad smell component into an odorless component before it is diffused outside.

The air including vaporized water enters the reduction catalyst box 27 through the discharge pipe 28 and contact the heated heater 65 and is again increased in temperature. At the same time, the heat from the heater 65 heats the catalyst 66 so as to maintain a sufficient temperature by which the catalyst 66 performs its function. When the air including the vaporized water which is heated by the heater 65 passes through the catalyst 66 which is maintained at its operation temperature, the bad smell component included in the vaporized water is subject to oxidation-reduction and is changed so as to be odorless. Since a plurality of heaters 65 and catalysts 66 are layered vertically inside the reduction catalyst box 27, the urea, ammonia, etc. which are the bad smell components can be subject to oxidation-reduction with assurance. As a result, the air including the vaporized water which is discharged from the temporary toilet 1 is changed to odorless so that no bad smell is generated around the temporary toilet 1.

When the drying cauldron 19 and the stirring bodies 33 are heated by the heater unit 34, the liquid water which is the primary component of the raw sewage is changed into the vaporized water and is evaporated. If the heating of the drying cauldron 19 and the stirring bodies 33 continues for a given time, the raw sewage in the drying cauldron 19 is finally dried and the fibrous substance or ash included in the raw sewage which is not evaporated remains in the drying cauldron 19. The evaporation process is completed at this state.

When the evaporation process is completed, the residual substances remain inside the drying cauldron 19. If the residual substances remain as they are, they accumulate inside the drying cauldron 19, which prevents the raw sewage disposal apparatus 5 from being used for extended periods of time. Accordingly, if one or plurality of evaporation processes are performed, the inside of the drying cauldron 19 must be subjected to a cleaning process, thereby preventing the residual substances from accumulating in the drying cauldron 19. In the cleaning process, the motor 20 continues to operate so as to continuously rotate the drying cauldron 19 in a given direction by way of the small gear 40 and large gear 39. However, the motor 68 stops its operation so as to stop the flow of air through discharge port 50, discharge pipe 28 and reduction catalyst box 27. At the same time, the power supply to the heater 65 is stopped, thereby stopping the heating of the catalyst 66.

When the cleaning process starts, the elevating motor 56 is first operated so as to rotate the output shaft 57 and worm 58. As a result, the worm gear 59 meshing with the worm 58 is rotated so as to lower the screw rod 60, which is screwed into the worm gear 59 in the direction of arrow F in FIG. 9. Accordingly, the connecting rod 61 and the cleaning pipe 51 respectively fixed to the upper end of the screw rod 60 are likewise lowered in the direction of the arrow F so that the cleaning pipe 51 lowers inside the cleaning hole 49. Since the cleaning pipe 51 slides inside the cleaning hole 49 which is opened longitudinally in the baffle plate 46 when the cleaning pipe 51 lowers, the dust stuck to the inner wall of the cleaning hole 49 is sliced off at the tip end of the cleaning pipe 51. As a result, the lower end of the cleaning pipe 51 is forced to move downwardly toward a position adjacent to the lower end opening of the cleaning hole 49. When the cleaning pipe 51 is moved to its lowest position, the operation of the elevating motor 56 stops.

The operation of the motor 73 starts at the same time when the cleaning pipe 51 is lowered by the elevating motor 56. When the motor 73 starts operation, the fan 74 coupled to the motor 73 is rotated so as to discharge the air in the separation box 25 toward the outside through the air blower 72. Accordingly, the separation box 25 is under negative pressure so that the air in the drying cauldron 19 is permitted to flow through the inside of the cleaning pipe 51 and also through the joint pipe 26 and it is permitted to flow in the direction of arrow E in FIG. 10 so that it enters inside the dust collecting bag 71 of the separation box 25. In such a manner, when the air in the drying cauldron 19 is sucked, the residual substances remaining in the drying cauldron 19 and the air are permitted to flow through the cleaning pipe 51 and joint pipe 26 and permitted to move inside the dust collecting bag 71. The dust collecting bag 71 has such a characteristic that air flows inside and outside the dust collecting bag 71 and the fine particles such as dust can be caught by the dust collecting bag 71. The residual substances which are not evaporated from the raw sewage are sucked together with the air from the drying cauldron 19 and are caught by the dust collecting bag 71. The air alone, from which the dust is removed, can be passed through the dust collecting bag 71 and is discharged outside by the air blower 72.

The motor 20 continues to operate even when the suction and separation of the residual substances are performed and rotates the drying cauldron 19 in the direction of arrow C in FIG. 7. Accordingly, the stirring bodies 33 are rotated at the bottom portion of the drying cauldron 19 and they perform a friction motion at the bottom surface and inner sidewall of the drying cauldron 19 when they rotate. Accordingly, the residual substances stuck to the bottom surface and inner sidewall of the drying cauldron 19 are sliced off by the friction motion of the stirring bodies 33 and further they are crushed to small particles by the rotation of the stirring bodies 33 so that they are deformed and broken in shape so as to be movable by the flow of the air. In such a manner, the residual substances which are stuck to the bottom of the drying cauldron 19 and the surfaces of the stirring bodies 33, and which are not evaporated, are changed into fine dust so that they are moved together with the air through the cleaning pipe 51 and joint pipe 26 and are moved into the dust collecting bag 71 and are finally caught by the dust collecting bag 71. All the residual substances which remain inside the drying cauldron 19 are permitted to flow outside by the operation of the motors 20 and 73 for a given time, thereby completing the cleaning process of the drying cauldron 19.

When the cleaning of the inside of the drying cauldron 19 is completed, the raw sewage disposal apparatus 5 must be placed in standby for the next drying process. Accordingly, the raw sewage disposal apparatus 5 must be returned to its original state.

Accordingly, the operation of the motors 20 and 73 are first stopped. When the motor 20 stops, the drying cauldron 19 stops its rotation. When the motor 73 stops, the fan 74 stops its rotation so as to stop the suction of the air by the air blower 72. Accordingly, the flow of air through the cleaning pipe 51 and joint pipe 26 in the direction of the arrow E stops. When the elevating motor 56 is operated in the opposite direction so as to reverse the rotation of the output shaft 57 and worm 58, the worm gear 59 is reversely rotated so as to lift the screw rod 60 which is screwed into the worm gear 59 in the direction of the arrow G in FIG. 9. When the screw rod 60 is lifted in the direction of the arrow G, the cleaning pipe 51 moves upwardly inside the cleaning hole 49 and the lower end of the cleaning pipe 51 is pulled out until it reaches the upper portion of the cleaning hole 49. This is the standby state.

With the repetition of the standby state, use of the temporary toilet, starting of the drying process, cleaning process of the dust, and restoring the mechanism, the raw sewage discharged toward the stool 6 can be continuously evaporated and dried so that the vaporized water can be changed to be odorless and diffused outside and the dust which remain inside the drying cauldron 19 can be removed. A series of operations can be continuously performed until the supply of power to the temporary toilet 1 is stopped or the power supply switch (not shown) is released.

The stirring bodies 33 according to the present embodiment are formed of metallic materials and generates heat by the electromagnetic wave. However, the materials of the stirring bodies 33 may be formed of ceramics or sintered materials such as china and porcelain. In this case, the stirring bodies 33 per se do not generate heat by the electromagnetic wave but they perform the stirring of the raw sewage and the slicing of the residual substances and the powdering of the residual substances when the stirring bodies 33 rotate.

With the aforementioned arrangement of the present invention, it is not necessary to provide a rotatable blade and shaft inside the drying cauldron, thereby increasing the usable inner space of the drying cauldron. Further, since the raw sewage can be stirred and the stirring bodies can be rotated when the drying cauldron per se is rotated, the use of a separate stirring blade can be dispensed with. Even if a metallic ball-point pen or like article is introduced into the drying cauldron 19, these foreign matters do not create trouble due to the lack of a rotary blade mechanism.

The residual substances which remain inside the drying cauldron after the evaporation of the raw sewage can be sliced off by the stirring bodies and at the same time they are powdered, and hence the automatic cleaning process can be performed by sucking the powdered dust. Accordingly, the dusts which remain after the completion of the evaporation is not accumulated in the drying cauldron so that the drying cauldron can always be maintained at its initial state. As a result, the drying cauldron can be continuously used for a long time without maintenance.

The embodiments of the invention in which an exclusive property or privilege is claimed are defined as follows:

1. A raw sewage disposal apparatus comprising:

a metallic container for accommodating raw sewage therein, said container having a bottom and an upper open end;

a cover plate for covering said upper open end of said container;

an electromagnetic heating unit provided adjacent to said container for generating a high-frequency electromagnetic wave;

a holder for rotatably holding said container about a vertical axis of said container;

a driving means for rotating said container;

at least one spherical stirring member accommodated in said container;

at least one nonrotatable baffle having an upper end affixed to said cover plate and a lower end extending to a position adjacent to the bottom of said container so as to contact said stirring member; and a cleaning hole extending through said one nonrotatable baffle, said cleaning hole opening at an upper end thereof at said cover plate and opening at a lower end thereof in the vicinity of the bottom of said container.

2. A raw sewage disposal apparatus according to claim 1 including:

a stool for collecting the raw sewage; and an introduction pipe communicating with said stool and said container for introducing the raw sewage from said stool to said container.

3. A raw sewage disposal apparatus according to claim 2, including a valve provided in said introduction pipe for selectively permitting said stool to communicate with said container.

4. A raw sewage disposal apparatus according to claim 1, including a deodorizing unit communicating with an inner space of said container for removing air from inside said container so as to remove bad odor from said container.

5. A raw sewage disposal apparatus according to claim 4, wherein said deodorizing unit comprises an airtight reduction catalyst box, a heater and a catalyst respectively contained in the reduction catalyst box, an air blower for discharging the air in said reduction catalyst box to the atmosphere, and a discharge pipe for permitting said container to communicate with said reduction catalyst box.

6. A raw sewage disposal apparatus according to claim 1, including a dust collecting unit communicating with an inner space of said container for removing dust laden air from inside said container.

7. A raw sewage disposal apparatus according to claim 6, wherein said dust collecting unit comprises an airtight separation box, a dust collecting bag contained in said separation box for separating dust from the dust laden air and collecting the separated dust therein, an air blower for discharging the air in the separation box to the atmosphere, and a joint pipe for permitting the container to communicate with said separation box.

8. A raw sewage disposal apparatus according to claim 1, including:

a stool for collecting said raw sewage;

an introduction pipe communicating with said stool and said container for introducing said raw sewage from said stool to said container;

a deodorizer means communicating with an inner space of said container for removing air from inside said container so as to remove bad odor from said container; and a dust collector means communicating with an inner space of said container for removing air from inside said container so as to remove dust laden air from said container.

9. A raw sewage disposal apparatus according to claim 8, wherein said dust collecting unit comprises an airtight separation box, a dust collecting bag contained in said separation box for separating dust from the dust laden air and collecting the separated dust therein, an air blower for discharging the air in the separation box to the atmosphere, and a joint pipe for permitting the container to communicate with said separation box.

10. A raw sewage disposal apparatus according to claim 1, wherein said container comprises a drying cauldron which is rotatably held about a vertical axis thereof and has an upper open end and a lower closed bottom, and said cover plate is provided adjacent to the upper open end of said drying cauldron and is fixed not to rotate.

11. A raw sewage disposal apparatus according to claim 10, wherein a seal is fixed to the lower surface of said cover plate to create an air tight fit between said upper open end of said drying cauldron and said cover plate.

12. A raw sewage disposal apparatus according to claim 10, wherein said drying cauldron has an upheaved, ridge-like bottom central portion.

13. A raw sewage disposal apparatus according to claim 10, wherein said at least one baffle comprises a rod-shaped pillar which extends toward said lower closed bottom of said drying cauldron and is positioned close to an inner sidewall of said drying cauldron, and wherein said one baffle has an upper end fixed to said cover plate and a lower end positioned adjacent to the bottom of said drying cauldron.

14. A raw sewage disposal apparatus according to claim 1, wherein said cleaning hole vertically penetrates said one baffle, a cleaning pipe is vertically slidable into said cleaning hole, and wherein said cleaning pipe is connected to an insertion operation means for lowering said cleaning pipe to clean the inside of said container for vacuuming dust laden air from said container, and wherein a joint pipe is connected between a separation box and an upper end of said cleaning pipe.

* * * * *